US009093746B2

(12) United States Patent
Ko et al.

(10) Patent No.: US 9,093,746 B2
(45) Date of Patent: Jul. 28, 2015

(54) WIRELESS COMMUNICATION DEVICE HAVING METAL ASSEMBLY AND CONDUCTIVE ASSEMBLY FOR REDUCING SPECIFIC ABSORPTION RATE (SAR)

(71) Applicant: FIH (Hong Kong) Limited, Kowloon (HK)

(72) Inventors: Cheng-Hung Ko, Shindian (TW); Chao-Wei Ho, New Taipei (TW)

(73) Assignee: FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 14/132,488

(22) Filed: Dec. 18, 2013

(65) Prior Publication Data

US 2014/0375506 A1 Dec. 25, 2014

(30) Foreign Application Priority Data

Jun. 24, 2013 (TW) ..... 102122425 A

(51) Int. Cl.

| | |
|---|---|
| ***H01Q 1/38*** | (2006.01) |
| ***H01Q 1/24*** | (2006.01) |
| ***H01Q 9/04*** | (2006.01) |
| ***H01Q 5/371*** | (2015.01) |

(52) U.S. Cl.
CPC ..... *H01Q 1/243* (2013.01); *H01Q 1/245* (2013.01); *H01Q 5/371* (2015.01); *H01Q 9/0421* (2013.01)

(58) Field of Classification Search
CPC ..... H01Q 1/38; H01Q 9/0407; H01Q 1/50
USPC ..... 343/700 MS, 745, 749, 845, 850, 898
See application file for complete search history.

(56) References Cited

U.S. PATENT DOCUMENTS

| | | | | |
|---|---|---|---|---|
| 6,380,895 | B1 * | 4/2002 | Moren et al. | 343/700 MS |
| 7,859,471 | B2 * | 12/2010 | Bungo et al. | 343/702 |
| 2008/0246674 | A1 * | 10/2008 | Rutfors et al. | 343/722 |
| 2009/0073048 | A1 * | 3/2009 | Kim | 343/700 MS |
| 2009/0079637 | A1 * | 3/2009 | Fukui et al. | 343/700 MS |

* cited by examiner

*Primary Examiner* — Sue A Purvis
*Assistant Examiner* — Jae Kim
(74) *Attorney, Agent, or Firm* — Novak Druce Connolly Bove + Quigg LLP

(57) ABSTRACT

A wireless communication device includes a base board, an antenna, a metal assembly, and a conductive assembly. The base board includes a feed portion and a ground portion, and defines a keep-out-zone. The antenna is located above the keep-out-zone, and is electronically connected to the feed portion and the ground portion. The metal assembly is located at the keep-out-zone, and is spaced from the antenna. The metal assembly is electronically connected to the feed portion and the ground portion through the conductive assembly.

9 Claims, 1 Drawing Sheet

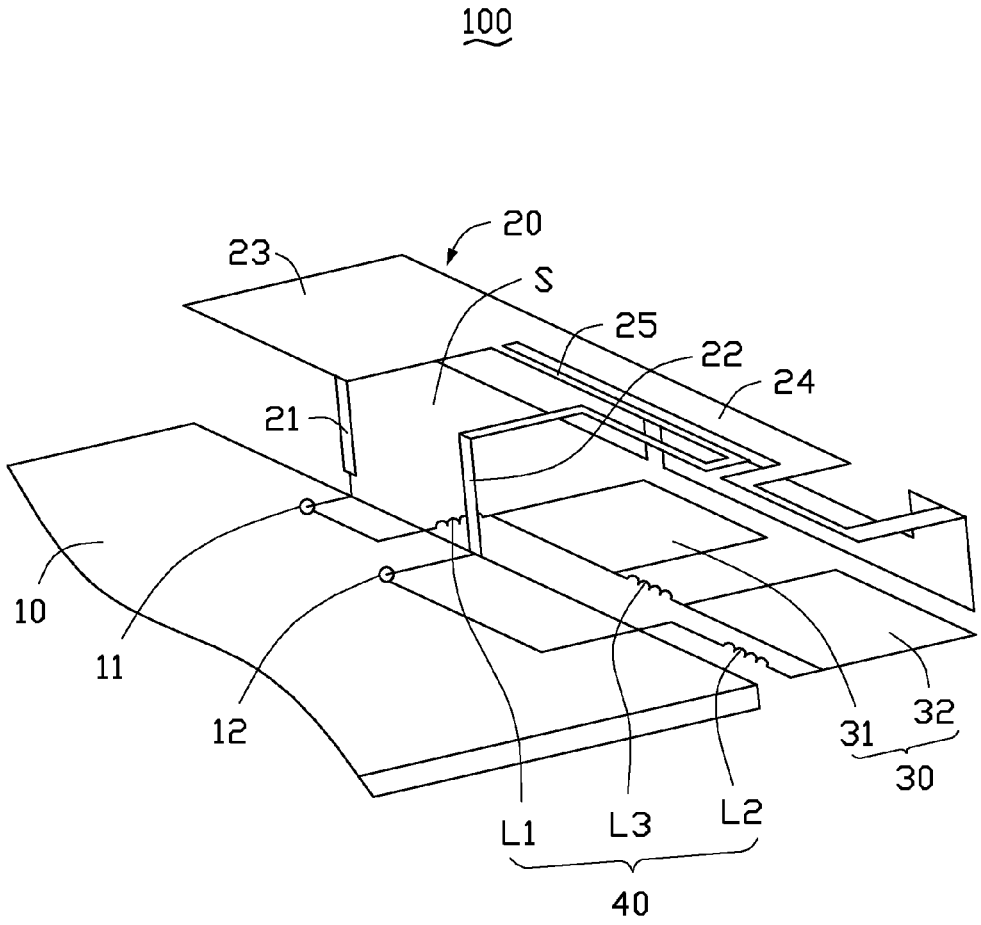
100
20
23
S
25
22
24
21
10
11
12
31
32
30
L1
L3
L2
40

WIRELESS COMMUNICATION DEVICE HAVING METAL ASSEMBLY AND CONDUCTIVE ASSEMBLY FOR REDUCING SPECIFIC ABSORPTION RATE (SAR)

BACKGROUND

1. Technical Field

The present disclosure relates to a wireless communication device employing an antenna.

2. Description of Related Art

A dual-band antenna is commonly a planar antenna, which includes a first radiating portion for transmitting/receiving wireless signals at high frequencies and a second radiating portion for transmitting/receiving wireless signals at low frequencies The first and second radiating portions are usually connected to a feed end of the dual-band antenna. During testing of specific absorption rate (SAR) of the dual-band antenna, current from the feed end may be added together. Since the SAR mainly depends on the current intensity of the antenna, thus SAR at the feed end becomes too high, which may negatively influence users.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

The FIGURE is an isometric view of a wireless communication device, according to an exemplary embodiment.

DETAILED DESCRIPTION

The disclosure is illustrated by way of example and not by way of limitation in the FIGURES of the accompanying drawings in which like references indicate similar elements. It should be noted that references to "an" or "one" embodiment in this disclosure are not necessarily to the same embodiment, and such references mean "at least one."

The FIGURE shows a wireless communication device 100 according to an exemplary embodiment. The wireless communication device 100 may be a mobile phone or a personal digital assistant, for example.

The wireless communication device 100 includes a base board 10, an antenna 20, a metal assembly 30, and a conductive assembly 40. The antenna 20 is located above the base board 10, the metal assembly 30 and the conductive assembly 40 are positioned at a side of the base board 10.

The base board 10 is a printed circuit board (PCB) of the wireless communication device 100, and is made of composite materials. A feed portion 11 and a ground portion 12 are electrically mounted on the base board 10. The feed portion 11 provides current to the antenna 20, and the antenna 20 is grounded by the ground portion 12. In one exemplary embodiment, the feed portion 11 is a circular shaped metal sheet, current on a center of the feed portion 11 is greater than current on other positions of the feed portion 11.

A keep-out-zone S is defined at a side of the base board 10. The purpose of keep-out-zone S is to not permit other elements (such as a camera, a vibrator, a speaker, etc.) on the base board 10 to be placed in a predetermined area where it may interfere with the antenna. In one exemplary embodiment, The antenna 20 is located above the keep-out-zone S, the metal assembly 30 and the conductive assembly 40 are positioned at the keep-out-zone S.

In one exemplary embodiment, the antenna 20 is a planar inverted-F antenna (PIFA), and includes a feed end 21, a ground end 22, a connection body 23, a first radiator 24, and a second radiator 25. The feed end 21 is electronically connected to the center of the feed portion 11. The connection body 23 is a rectangular sheet, and is perpendicularly connected to a distal end of the feed end 21. Both of the first radiator 24 and the second radiator 25 are connected to the connection body 23, and a gap (not shown) is defined between the first radiator 24 and the second radiator 25. The ground end 22 is electronically connected to the ground portion 12, and the second radiator 25 is perpendicularly connected to the ground end 22. In one exemplary embodiment, the antenna 20 can receive/transmit wireless signals having the central frequency of about 1852 MHz, 1880 MHz, and 1908 MHz.

Since the feed end 21 is electronically connected to the center of the feed portion 11, current from the feed portion 11 is gathered around the feed end 21. For example, the current from the feed portion 11 is gathered at the feed end 21 and the connection body 23.

The metal assembly 30 includes a plurality of metal sheets. In one exemplary embodiment, the metal assembly 30 includes a first metal sheet 31 and a second metal sheet 32. The first metal sheet 31 and the second metal sheet 32 are located at the keep-out-zone S, and are spaced from the first radiator 24 and the second radiator 25.

The conductive assembly 40 is connected between the base board 10 and the metal assembly 30. In one exemplary embodiment, the conductive assembly 40 includes a first inductor L1, a second inductor L2, and a third inductor L3. The first inductor L1 is connected between a peripheral edge of the feed portion 11 and the first metal sheet 31. The second inductor L2 is connected between the second metal sheet 32 and the ground portion 12. The third inductor L3 is connected between the first metal sheet 31 and the second metal sheet 32.

Referring to the table 1, when the metal assembly 30 and the conductive assembly 40 are incorporated into the wireless communication device 100, the specific absorption rate (SAR) of the antenna 20 is significantly reduced. For example, when the antenna 20 receives/transmits wireless signals having the central frequency of about 1852 MHz, the SAR of the wireless communication device 100 is reduced about 0.19 (1.14−0.95=0.19).

The table 1 sets out a relation among frequencies, SAR of the wireless communication device 100 having the metal assembly 30 and the conductive assembly 40, and SAR of the wireless communication device 100 lacking the metal assembly 30 and the conductive assembly 40:

| Signal | Frequencies (MHz) | SAR of the wireless communication device 100 lacking the metal assembly 30 and the conductive assembly 40 (1 g) | SAR of the wireless communication device 100 having the metal assembly 30 and the conductive assembly 40 (1 g) |
|---|---|---|---|
| WCDMA BAND 2 | 1852 | 1.14 | 0.95 |
| | 1880 | 1.42 | 1.06 |
| | 1908 | 1.85 | 1.37 |

The table 2 shows that when the metal assembly 30 and the conductive assembly 40 are incorporated into the wireless communication device 100, the insertion loss efficiency of the antenna 20 is significantly reduced, and the radiation efficiency of the wireless communication device 100 is greater than 20 percent, thereby satisfying communication standards.

Table 2 sets out a relation among frequencies, an insertion loss efficiency of the antenna 20, and a radiation efficiency of the wireless communication device 100:

| Signal | Frequencies (MHz) | Wireless communication device | Radiation efficiency of the antenna | Insertion loss efficiency of the antenna | Radiation efficiency of the wireless communication device |
|---|---|---|---|---|---|
| WCDMA BAND 2 | 1852 | Lacking the metal assembly 30 and the conductive assembly 40 | 31.30% | 81.50% | 25.30% |
| | | Having the metal assembly 30 and the conductive assembly 40 | 28.70% | 75.50% | 21.70% |
| | 1880 | Lacking the metal assembly 30 and the conductive assembly 40 | 31.60% | 87.10% | 27.50% |
| | | Having the metal assembly 30 and the conductive assembly 40 | 29.10% | 81.00% | 23.60% |
| | 1908 | Lacking the metal assembly 30 and the conductive assembly 40 | 31.70% | 92.60% | 29.00% |
| | | Having the metal assembly 30 and the conductive assembly 40 | 29.30% | 89.20% | 26.00% |

Since the metal assembly 30 is located at the keep-out-zone S, and is electronically connected to the base board 10 through the conductive assembly 40, a proportion of the current can be absorbed by the metal assembly 30, thereby reducing the current intensity on the feed end 21 of the antenna 20 and changing distributions of the current on the antenna 20. Thus, the SAR of the antenna 20 is significantly reduced. Additionally, the first inductor L1 is connected to the peripheral edge of the feed portion 11 to obtain small current, thus, the radiation efficiency of the wireless communication device 100 will not be negatively influenced.

In other exemplary embodiments, the conductive assembly 40 can be a plurality of capacitors.

In summary, the conductive assembly 40 obtains a proportion of the current from the base board 10, and the metal assembly 30 absorbs the proportion of the current. Thus, the current flowing to the antenna 20 is reduced, and the antenna 20 has a dispersed and even electromagnetic radiation field and obtains a reduced SAR.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A wireless communication device, comprising:

a base board having a feed portion and a ground portion, a keep-out-zone defined at a side of the base board;

an antenna located above the keep-out-zone, and electronically connected to the feed portion and the ground portion;

a metal assembly located within the keep-out-zone, and spaced from the antenna; and a conductive assembly;

wherein the metal assembly comprises a first metal sheet and a second metal sheet, the conductive assembly comprises a first inductor, a second inductor, and a third inductor, the first inductor is connected between the feed portion and the first metal sheet, the second inductor is connected between the second metal sheet and the ground portion via a path that does not include the third inductor, the third inductor is connected between the first metal sheet and the second metal sheet wherein the metal assembly is electronically connected to the feed.

2. The wireless communication device as claimed in claim 1, wherein the feed portion is a circular shaped metal sheet having a center and a peripheral location surrounding the center, the antenna is connected to the center of the feed portion.

3. The wireless communication device as claimed in claim 2, wherein the first inductor is connected to the peripheral location of the feed portion.

4. The wireless communication device as claimed in claim 1, wherein the antenna comprises a feed end and a ground end, the feed end is electronically connected to the feed portion, and the ground end is electronically connected to the ground portion.

5. The wireless communication device as claimed in claim 4, wherein the antenna further comprises a connection body, a first radiator, and a second radiator, the connection body is a rectangular sheet, and is perpendicularly connected to a distal end of the feed end, both of the first radiator and the second radiator are connected to the connection body, and the second radiator is perpendicularly connected to the ground end.

6. A wireless communication device, comprising:

a base board having a feed portion for providing current;

an antenna located above the base board, and electronically connected to the feed portion to receive the current;

a metal assembly spaced from the antenna; and a conductive assembly electronically connected to the feed portion and metal assembly;

wherein the metal assembly comprises a first metal sheet and a second metal sheet, the conductive assembly comprises a first inductor, a second inductor, and a third inductor, the first inductor is connected between the feed portion and the first metal sheet, the second inductor is connected between the second metal sheet and the ground portion via a path that does not include the third inductor, the third inductor is connected between the first metal sheet and the second metal sheet; and wherein the first inductor obtains a proportion of the current from the feed portion, and the metal assembly absorbs the proportion of the current.

7. The wireless communication device as claimed in claim 6, wherein the base board defines a keep-out-zone, the antenna is located above the keep-out-zone, and the metal assembly located at the keep-out-zone.

8. The wireless communication device as claimed in claim 6, wherein the feed portion is a metal sheet with circular shape having a center and a peripheral location surrounding the center, the antenna is connected to a center of the feed portion.

9. The wireless communication device as claimed in claim 8, wherein the first inductor is connected to the peripheral location of the feed portion.

* * * * *